US006269889B1

(12) United States Patent
Wentworth

(10) Patent No.: US 6,269,889 B1
(45) **Date of Patent: *Aug. 7, 2001**

(54) GROUND PIERCING TOOL WITH PLASTIC BODY

(75) Inventor: Steven W. Wentworth, Brookfield, WI (US)

(73) Assignee: Earth Tool Company, L.L.C., Oconomowoc, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/957,803

(22) Filed: Oct. 24, 1997

(51) Int. Cl.[7] ..... E21B 7/26; B25D 9/04
(52) U.S. Cl. ..... 173/91; 173/19
(58) Field of Search ..... 173/91, 90, 128, 173/127; 175/19, 296, 40

(56) References Cited

U.S. PATENT DOCUMENTS

| | | | | |
|---|---|---|---|---|
| 4,496,007 | * | 1/1985 | Zinck | 173/127 |
| 4,693,335 | * | 9/1987 | Almon | 175/40 |
| 4,854,398 | * | 8/1989 | Holloway | 175/19 |
| 5,025,868 | | 6/1991 | Wentworth et al. . | |
| 5,249,634 | * | 10/1993 | Bueter et al. | 173/91 |
| 5,465,797 | | 11/1995 | Wentworth et al. . | |
| 5,467,831 | * | 11/1995 | Spektor | 173/91 |
| 5,487,430 | | 1/1996 | Wentworth et al. . | |
| 5,494,116 | * | 2/1996 | Wentworth | 173/91 |
| 5,540,294 | * | 7/1996 | Anderberg | 175/19 |

OTHER PUBLICATIONS

Hammerhead Mole Accessories Catalog, pp. 11–20, Feb. 1995.

* cited by examiner

*Primary Examiner*—Scott A. Smith
(74) *Attorney, Agent, or Firm*—Philip G. Meyers; Philip G. Meyers Intellectual Property Law, P.C.

(57) ABSTRACT

A ground piercing tool of the invention includes an elongated tubular housing having front and rear openings, a head including an anvil secured in the front opening of the housing, a striker disposed for reciprocation within an internal chamber of the housing to impart impacts to a rear impact surface of the anvil for driving the tool through the ground, a reciprocation mechanism for reciprocating the striker, and a tail assembly mounted in a rear end opening of the housing that secures the striker and reciprocation mechanism in the housing. A plastic tube forms the body of the housing, and the plastic tube is secured to the head. The reciprocation mechanism is preferably an air distributing mechanism that uses compressed air to reciprocate the striker. Such a tool can be used to install an underground pipe by welding a front end of the replacement pipe coaxially to a rear end of the plastic tube, operating the tool over a run to pull the pipe into the ground, and when the tool has reached the end of the run, disconnecting the tool from the replacement pipe.

11 Claims, 2 Drawing Sheets

GROUND PIERCING TOOL WITH PLASTIC BODY

TECHNICAL FIELD

This invention relates to impact tools and methods of use of such tools, particularly self-propelled pneumatic ground piercing tools.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped steel body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have an air distributing mechanism which utilizes a stepped air inlet. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearwardly, the radial holes pass back over the step and isolate the front chamber of the tool from the compressed air supply. The momentum of the striker carries it rearward until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe, which is secured to the body by a radial flange having exhaust holes therethrough, and a stepped bushing connected to the air inlet pipe by a flexible hose. These tools have been made reversible by providing a threaded connection between the air inlet sleeve and the surrounding structure which holds the air inlet concentric with the tool body. The threaded connection allows the operator to rotate the air supply hose and thereby displace the stepped air inlet rearwardly relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearward out of the hole. See, for example, Wentworth et al. U.S. Pat. Nos. 5,025,868 and 5,337,837.

Expanders are tapered, ring-shaped shells that fit over the tapered nose portion of an earth boring tool in order to widen the hole made by the tool as it passes through the ground. In this manner, a 4 inch diameter tool may be used to make a 6 or 8-inch diameter hole. The tool is often sent through to make an initial bore, and then sent through a second time with the expander in order to widen the existing hole and/or crack an existing pipe. According to a known method, a plastic pipe may be attached to the back of the expander with the above described reversible tool inside the pipe so that the pipe is installed as the tool moves through the soil, with or without additional widening of the bore.

The tool body of the pneumatic impact tool used in such pipe pulling operations is the single largest and most expensive component of the tool, weighing over 1000 pounds in a large diameter tool. Known tool bodies include a long tubular housing and a tapered nose, which may be integral with the housing or a separate assembly secured to it. The former are made by machining or by swaging as described in Wentworth et al. U.S. Pat. No. 5,487,430, issued Jan. 30, 1996. The present invention provides a pneumatic impact tool specially adapted for pipe pulling operations in which the traditional tubular steel tool body is eliminated.

SUMMARY OF THE INVENTION

A ground piercing tool of the invention includes an elongated tubular housing having front and rear openings, a head including an anvil secured in the front opening of the housing, a striker disposed for reciprocation within an internal chamber of the housing to impart impacts to a rear impact surface of the anvil for driving the tool through the ground, a reciprocation mechanism for reciprocating the striker, and a tail assembly mounted in a rear end opening of the housing that secures the striker and reciprocation mechanism in the housing. According to the invention, a plastic tube forms the body of the housing, and suitable means are provided for securing the plastic tube to the head, which is made of steel or a material of comparable strength. The reciprocation mechanism is preferably an air distributing mechanism that uses compressed air to reciprocate the striker, but a hydraulic or electric reciprocating mechanism could also be used.

According to another aspect of the invention, a method using the foregoing tool is provided for installing an underground pipe. This method includes the steps of welding a front end of the replacement pipe coaxially to a rear end of the plastic tube, operating the tool over a run to pull the pipe into the ground, and when the tool has reached the end of the run, disconnecting the tool from the replacement pipe, preferably by sawing through either the plastic tube or the replacement pipe at the weld or a location proximate the weld.

Other objects, features and advantages of the invention will become apparent from the following detailed description. It should be understood, however, that the detailed description is given by way of illustration only, since various changes and modifications within the spirit and scope of the invention will become apparent to those skilled in the art from this detailed description.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 1:
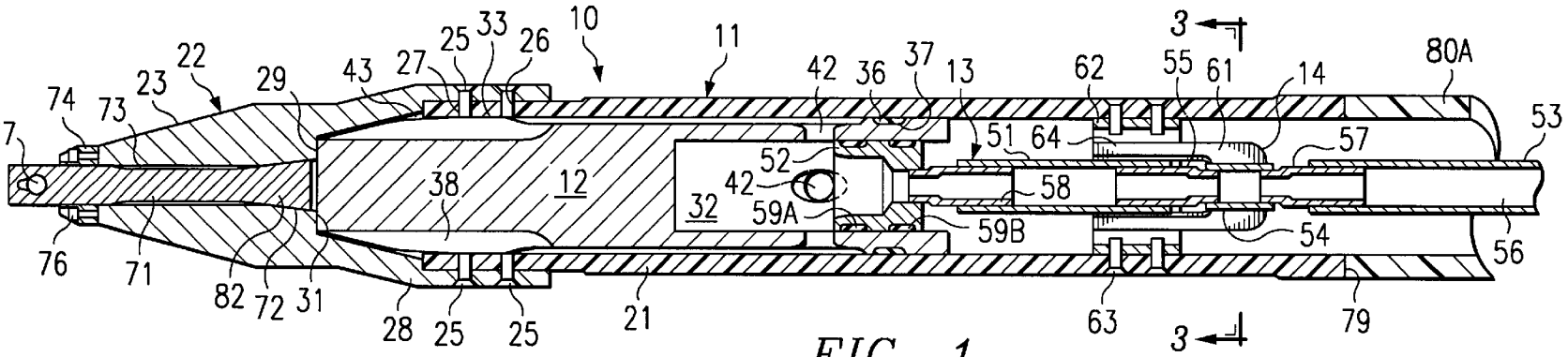
FIG. 1 is a lengthwise sectional view of an apparatus according to the invention.
Figure 2:
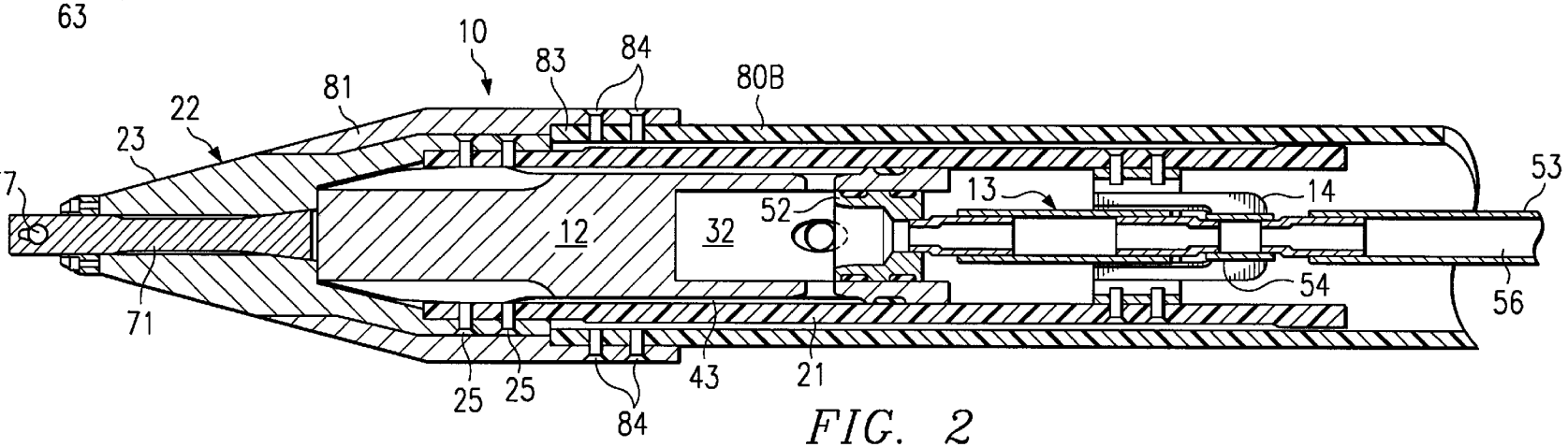
FIG. 2 is a lengthwise sectional view of the apparatus of FIG. 1, fitted with an expander for pulling an oversize replacement pipe.
Figure 3:
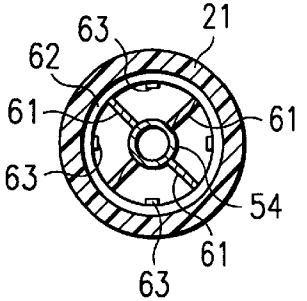
FIG. 3 is a cross-sectional view taken along the line 3—3 in FIG. 1.

Referring now to FIGS. 1–3, a pneumatic impact tool 10 includes, as main components, a tool body 11, a striker 12 for impacting against the interior of body 11 to drive the tool forward, an air distributing mechanism in the form of a stepped air inlet conduit 13 which cooperates with striker 12 for supplying compressed air to reciprocate striker 12, and a tail assembly in the form of a valve anchor 14 which allows exhaust air to escape from the tool and secures conduit 13 to body 11.

Tool body 11 of the invention comprises a cylindrical plastic tubular housing (tube) 21 and a bursting head 22 having a forwardly tapered outer surface 23. Plastic tube 21 is made of a high-strength, highly rigid plastic such as high density polyethylene (HDPE), whereas bursting head 22 is normally made of a rigid, impact-resistant metal such as steel. Plastic tube 21 has an outer diameter of from about 4 to 24 inches and a thickness of from about 0.3 to 2.0 inches, the required thickness being less for smaller diameter pipes. In particular, to accommodate the air pressures commonly used in such tools, the thickness of the pipe should about 8% the outer diameter of the tool. Screws 25 set flush in aligned holes 26, 27 in a tubular rear portion 28 of head 22 and a front end portion of tube 21, respectively, removably secure bursting head 22 to tube 21. Other suitable means for securing head 22 to tube 21 may also be employed, for example a threaded connection, an adhesive, welding, friction-based pulling devices such as a steel mesh that tightens about the surface of the plastic tube, and other alternative mechanical fasteners.

Striker 12 is disposed for sliding, back-and-forth movement inside of tool body 11 forwardly of conduit 13 and valve anchor 14. Striker 12 comprises a cylindrical rod having a rearwardly opening recess 32. A front bearing land 33 and a rear plastic bearing ring 36 disposed in an annular groove 37 in the outer periphery of striker 12 support it for movement along the inner surface of tube 21. Annular land 33 is interrupted by a pair of external grooves or flats 38 at the front of striker 12 which conduct compressed air to the front of the striker 12.

A circular front impact surface 29 of striker 12 impacts against an impact surface 31 formed on the inside of bursting head 22 as shown in FIG. 1. A number of rear radial holes 42 in striker 12 allow communication between recess 32 and an annular space 43 between striker 12 and tube 21. Annular space 43 and flats 38 comprise the front, variable pressure chamber of the tool.

Stepped air inlet conduit 13 includes a flexible hose 51 and a tubular bushing 52. Hose 51, which may be made of rubberized fabric, is secured to a fitting 55 threadedly coupled to a front end opening of a central tubular inner sleeve or hub 54 of valve anchor 14, which is in turn coupled by a fitting 57 to a further length of hose 53 which ultimately connects tool 10 with the air compressor. The inner end of hose 51 is secured to a rear end of a fitting 58, which is threadedly coupled to a rear end opening of bushing 52. An axial bore 56 which extends through hub 54, hose 51, and bushing 52 allows compressed air to pass from hose 53 through recess 32.

The cylindrical outer surface of bushing 52 is inserted into recess 32 in slidable, sealing engagement with the wall thereof. Recess 32 and the adjoining interior space of stepped conduit 13 together comprise a rear, constant pressure chamber which communicates intermittently with the front, variable pressure chamber by means of holes 42. Bushing 52 may, if needed, have a pair of front and rear plastic bearing rings 59A, 59B disposed in respective annular peripheral grooves to reduce air leakage between bushing 52 and the wall of recess 32.

Valve anchor 14 is considerably simpler in structure than tail assemblies employed in comparable known tools. As shown in FIG. 3, four thin, flat spokes 61 connect hub 54 to an annular outer sleeve 62. Sleeve 62 is in close contact with the inner surface of tube 21 and is removably secured thereto by countersunk screws 63 positioned at positions midway between adjoining spokes 61. Four sets of screws 63 set 90° apart are used with four spokes 61 set 90° apart. However, other arrangements may be employed, and alternate means for fastening may be used as described above in connection with screws 25. In the illustrated embodiment, spokes 61 include outer, forward extensions 64 which permit sleeve 62 to be located forwardly of hub 54 for convenience of installation and to provide a broader surface for engaging the inner surface of plastic tube 21. The external surface of outer sleeve 62 may be barbed or roughened to provide better engagement with the inside of tube 21. Exhaust from the front pressure chamber passes between spokes 61 and exits through replacement pipe 80A.

Bursting head 22 may optionally include forwardly directed blades or sharp edges to aid in pipe bursting, as known in the art. Head 22 may comprise a single piece, or may include a central rod 71 having a frustoconical rear end portion that is seated in a tapered rear end opening 72 of a central bore 73 in head 22. A front locking ring 74 is threadedly coupled to the outside of a frontwardly protruding portion of rod 71. Screws 76 are adjusted to push against the front face of head 22, putting rod 71 under lengthwise tension. The frontwardly protruding portion of rod 71 has an eye 77 for attachment of a towing cable. Rod 71 may be replaced as needed; eye (or clevis) 77 occasionally breaks. The rear end of rod 71 is slightly spaced from the rear wall of head 22, so that rod 71 does not receive direct impacts from striker 12.

A replacement pipe 80A having the same outer diameter as tool body 11 is attached by any suitable means to a rear end portion of body 11, most preferably by welding to form a weld 79. This is particularly advantageous where tool body 11 is itself a section of the same HDPE pipe 80A to be installed. To form an effective weld, the tool body and replacement pipe must be made of compatible materials, and would normally be made of the same material. In this manner, towing of the replacement pipe can be carried out without an adapter or similar device for pulling the replacement pipe along. However, a towing connector of a type known in the art may be employed if desired. Tool 10 as such can be provided by sawing off a suitable length of a replacement pipe and installing the striker 12, air inlet conduit 13 and valve anchor 14 by drilling holes and mounting screws as described above.

FIG. 2 illustrates an alternate use of tool 10 wherein the tool is used to install a replacement pipe 80B having a larger diameter than tool body 11. An expander collar 81 is fitted to and held against rearward movement by a tapered rear portion 82 of head 22. A rearwardly opening counterbore 83 receives a front end of the replacement pipe 80B, which is secured thereto by two or more sets of screws 84 in the same manner as head 22 is secured to plastic tube 21. Alternate means for fastening may be used instead of screws 84 as described above in connection with screws 25. Differently sized expanders may be used so that tool 10 can be adapted to various replacement pipe sizes. Pipe 80B may be any common commercially available plastic pipe, such as PVC, and need not have the high strength that tube 21 has.

Figure 4:
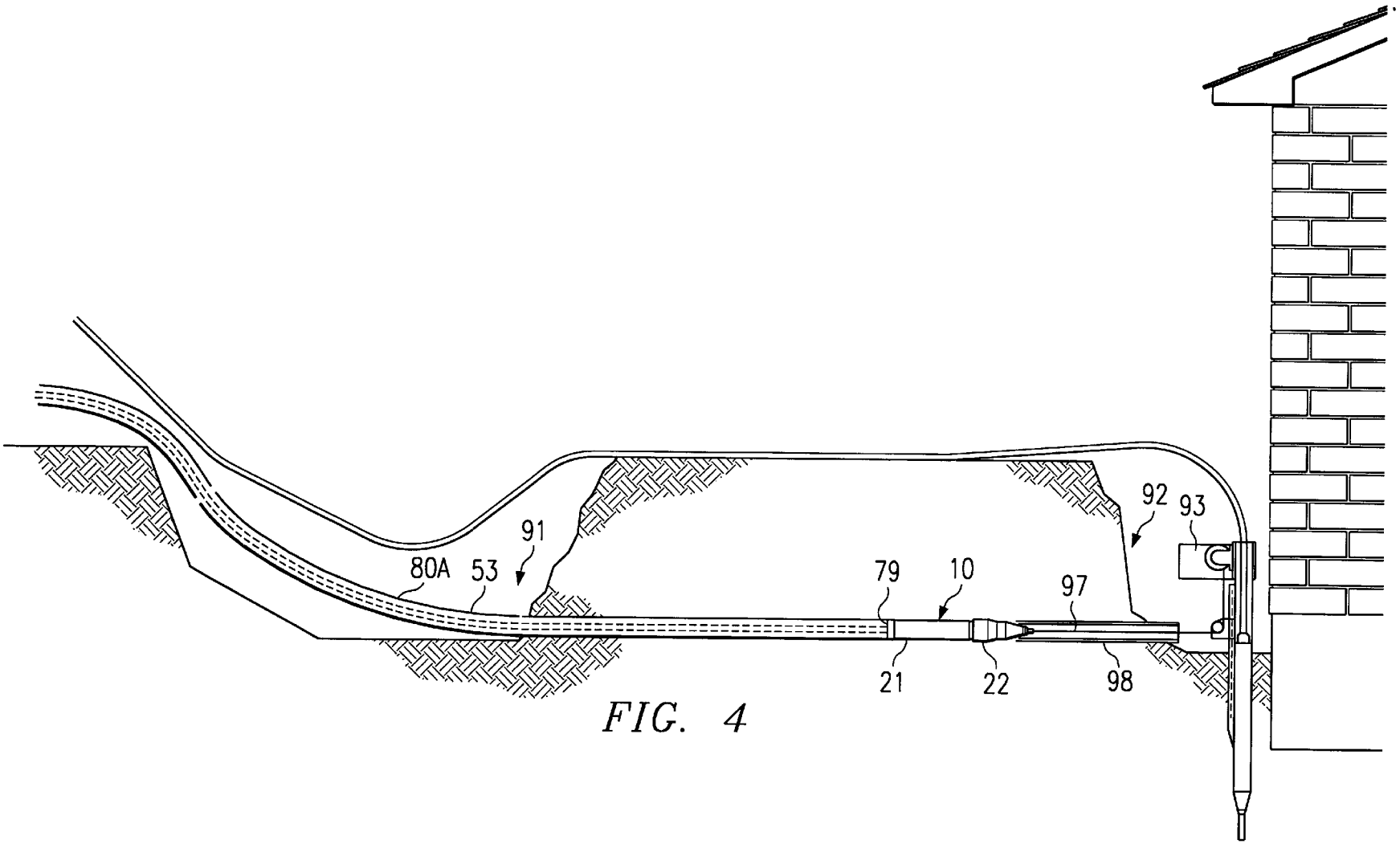
FIG. 4 is a schematic diagram of the tool of FIG. 1 used to carry out a pipe bursting and replacement method according to the invention.

FIG. 4 illustrates a method of the present invention using tool 10. Prior to the bursting and replacement operation, the rear end of tool body 11 is welded directly to the leading end of replacement pipeline 80A to be installed. In the alternative, pipe 80B is inserted into the gap between expander 81 and tool body 11 and secured to expander 81 with screws 84. Air hose 53 is fed through pipe 80A or 80B and connected to tool 10 for supplying compressed air to operate tool 10, which is then positioned at the entrance to the existing borehole or pipeline in a front (launch) pit 91.

At a rear (exit) pit 92, a pulling apparatus 93 is positioned near an exit opening of an existing pipeline 98, such as a 4-inch diameter clay pipe, to provide a pulling force on a steel cable 97 which extends in the axial direction through the interior of existing pipeline 98. Cable 97 may be threaded by hand using a fiberglass rod through pipeline 98 and is attached to eye 77. Cable 97 may comprise a steel cable, chain, rope, or other similar device. Pulling apparatus may be a truck-mounted winch, but is preferably a portable winch of the type described in co-pending U.S. Ser. No. 08/888,893, filed Jul. 7, 1997, the contents of which are incorporated by reference herein.

Pulling apparatus 93 is then operated to provide a continuous pulling force on tool 10. Tool 10 is placed with head 22 in contact with an entrance opening of the existing pipeline or borehole 98, and then operated in forward mode. Tool 10 moves progressively through the existing pipeline 98 as shown. Head 22 bursts (shatters or slits) pipeline 98 while tool 10 pulls replacement pipe 80A into position. Use of pulling apparatus 93 is optional, but is preferred because the pulling force in the lengthwise direction of pipeline 98 prevents tool 10 from going off course, and the extra pulling force prevents the tool from stalling during long runs (over 50 feet) due to the weight of the trailing plastic pipe.

Exit pit 92 may comprise an existing underground structure such as a manhole or basement. Once tool 10 emerges into pit 92 far enough so that the replacement pipeline can be separated, the compressed air supply is turned off. For the embodiment of FIG. 1, tool body 11 is sawed off from pipe 80A and then withdrawn from the pit 92. For the embodiment of FIG. 2, the tool must emerge into the pit far enough so that screws 84 of expander 81 can be removed. Expander 81 is then removed in the exit pit 92.

Tool 10 can be pulled out of pipe 80B in the forward direction, or if the greatest outer diameter of head 22 is less than the inner diameter of pipe 80B, tool 10 can be withdrawn rearwardly by pulling on air hose 53 or a cable trailing from the rear end of tool 10. The latter option may be best for situations where the exit pit is narrow, or a man-made obstacle (such as the diameter of a manhole opening) prevents tool 10 from being withdrawn from the exit pit. Even under such conditions, tool 10 can usually be withdrawn forwardly out of the exit pit because it is relatively short, e.g., 36 inches long, in comparison to conventional pneumatic ground piercing tools that include a full size steel body and a reversing mechanism.

Tool 10 cycles rapidly in comparison to conventional pneumatic ground piercing tools because the valve diameter is large relative to the weight of the striker. A conventional 12-inch diameter pneumatic uses a striker that weighs about 900 pounds and cycles about 250 times per minute, whereas tool 10 of the present invention in one preferred embodiment uses a 250 pound striker that cycles 550 times per minute. A striker having a weight of from about 50–500 pounds that cycles from 300–800 times per minute is generally preferred. The weight of the striker increases with increasing tool diameter, such that a 50 pound striker is preferred for a 4-inch tool and a 500 pound striker is preferred for a 24-inch tool. When used by attaching the replacement pipe directly to the back of the tool body, the tool of the invention provides more power than a comparable metal-bodied tool that is inserted inside the replacement pipe and pulls the pipe along using a expander. In such a situation, the tool diameter is reduced relative to the diameter of the existing pipeline to be ruptured and relative to the replacement pipe.

It will be understood that the foregoing description is of preferred exemplary embodiments of the invention, and that the invention is not limited to the specific forms shown. Modifications may be made in the design and arrangement of the elements without departing from the scope of the invention as expressed in the appended claims.

What is claimed is:

1. A ground piercing tool comprising:

a tool body including a bursting head having a front, forward tapered end and a rear end, the tool body further including a plastic tubular member having a front end portion thereof attached to the rear end of the bursting head and extending rearwardly thereof, the bursting head having a rearwardly opening recess into which the front end portion of the plastic tubular member is inserted, and having one or more holes which penetrate from an external surface of the bursting head to the rearwardly opening recess;

a striker disposed for reciprocation within an internal chamber of the tool body, the striker impacting the bursting head from behind and driving the tool through the ground;

a reciprocation mechanism disposed in the tool body for reciprocating the striker;

one or more fasteners inserted through the holes into the front end portion of the plastic tubular member to mechanically secure the plastic tubular member to the bursting head; and a plastic replacement pipe bonded coaxially to a rear end of the plastic tubular member.

2. The ground piercing tool of claim 1, wherein the reciprocation mechanism is an air distributing mechanism that reciprocates the striker when connected to a source of compressed air.

3. The ground piercing tool of claim 2, further comprising means for securing the striker and reciprocation mechanism in the tool body.

4. The ground piercing tool of claim 2, wherein the air distributing mechanism includes an inner sleeve, and the striker has a rearwardly opening recess therein, such that the inner sleeve conducts compressed air to the rearwardly opening recess of the striker to propel the striker forward.

5. The ground piercing tool of claim 4, wherein the striker has a rear radial passage through a wall enclosing the rearwardly opening recess to permit flow of compressed air to a front, variable-volume pressure chamber ahead of the striker, and a rear end portion having a seal bearing thereon rearwardly of the radial passage for sliding engagement with an interior surface of the tool body; and the inner sleeve comprises a stepped air inlet conduit that cooperates with the striker to impart repeated blows to the bursting head.

6. The ground piercing tool of claim 5, further comprising a tail assembly including an outer sleeve in close contact with the interior surface of the tool body, a spoke connecting the inner and outer sleeves, and means for securing the outer sleeve to the tubular plastic member.

7. The ground piercing tool of claim 1, wherein the replacement pipe is secured to the rear end of the tool body by a coaxial weld.

8. The ground piercing tool of claim 1, wherein the plastic tubular member and the replacement pipe each have an outer diameter in the range of 4 to 24 inches and a thickness of from about 0.3 to 2 inches.

9. The ground piercing tool of claim 8, wherein the plastic tubular member and the replacement pipe are each made of high density polyethylene.

10. The ground piercing tool of claim 1, wherein the fastener or fasteners comprise screws.

11. The ground piercing tool of claim 1, wherein the head comprises a steel sleeve having a forwardly tapered exterior surface.

* * * * *